US006947566B2

(12) United States Patent
Mears

(10) Patent No.: US 6,947,566 B2
(45) Date of Patent: Sep. 20, 2005

(54) METHOD AND APPARATUS FOR A PORTABLE PUBLIC ADDRESS SYSTEM

(76) Inventor: Raymond L. Mears, 756 Matt Hammond Rd., Calhoun, LA (US) 71225

( * ) Notice: Subject to any disclaimer, the term of this patent is extended or adjusted under 35 U.S.C. 154(b) by 919 days.

(21) Appl. No.: 09/970,378

(22) Filed: Oct. 2, 2001

(65) Prior Publication Data

US 2003/0063754 A1 Apr. 3, 2003

(51) Int. Cl.[7] ..... H04R 27/04
(52) U.S. Cl. ..... 381/75; 381/82
(58) Field of Search ..... 381/75, 82; 181/177

(56) References Cited

U.S. PATENT DOCUMENTS 2,983,791 A * 5/1961 Menarik et al. ..... 381/75
4,237,341 A * 12/1980 Richards ..... 381/75

OTHER PUBLICATIONS

The PT–1 is the original model shown here in a company brochure. Date unknown. USA.
The Power–T model introduced in Feb. 1998.
Power T revision 2 model shown here.

* cited by examiner

*Primary Examiner*—Brian T. Pendleton
(74) *Attorney, Agent, or Firm*—Robert N. Montgomery

(57) ABSTRACT

An improved light weight, portable public address system configured with high fidelity omni-directional and high wattage directional speakers for both indoor and outdoor use with a wide variety of sound inputs assembled in a self-contained, compact housing. Optional systems provide for the remote deployment of up to two speakers and the use of a remote wireless microphone. Improved options include a unique compact configuration that allows for modular construction of all components for plug and play operation and rapid field replacement; a weatherproof housing for operation in inclement weather, and a tape player to provide prerecorded programming.

23 Claims, 11 Drawing Sheets

METHOD AND APPARATUS FOR A PORTABLE PUBLIC ADDRESS SYSTEM

FIELD OF THE INVENTION

This invention relates generally to portable sound apparatus for public address and more particularly to compact, self contained high wattage, low voltage, battery-powered, modular systems suitable for both indoor and outdoor operation having remote microphone and watertight embodiments with improved, modular plug and play components.

GENERAL BACKGROUND

In general, public address systems are employed for the purpose of amplifying the reproduction of sound or allowing a speaker to be heard above background noise and/or by a large group of people. Portable, public address (PA) systems must address a wide variety of special problems. The environment in which such systems are frequently used may vary drastically from one location to another. For example, ball games and other athletic events or indoor lectures. The types of sounds being amplified may also vary depending on the type of event being addressed. For example, utilizing an amplified megaphone-type speaker generally used for voice amplification indoors or outdoors to play music distorts the sound, while utilizing relatively small music speakers, generally not directional, does not lend themselves to outdoor use. Acoustical feedback is always a problem with an outdoor system when used indoors. Therefore, a need exists for a more universal portable PA system that more closely meets the requirements of both indoor and outdoor environments for a variety of sound amplification. Further, a need also exists for a compact PA system that is user friendly, weather tight and readily field repairable. Therefore, an object of the present invention is to provide a compact, portable PA system that is lightweight, user friendly, readily adaptable to a wide variety of environments and types of sound reproduction, battery powered, low voltage with high wattage, capable of accommodating large and small audiences and field repairable by replacement of plug and play components.

It is a further object of the invention to provide a lightweight, portable, outdoor PA system for operation in inclement weather.

SUMMARY OF THE INVENTION

The present invention is an improved model referred to as the T3R model which is a 12 volt DC 15 to 30 watt, portable public address system configured with high fidelity omnidirectional and high wattage directional speakers for both indoor and outdoor use with a wide variety of sound inputs assembled in a self-contained, compact housing. Optional systems provide for the remote deployment of up to two speakers and the use of a remote, wireless microphone. The unique configuration, unlike earlier models, allows for modular construction of all components for plug and play operation and rapid field replacement. A new optional system now provides a weatherproof housing for operation in inclement weather.

Unlike earlier models, which were hard-wired 120 VAC/12 VDC systems whereby the system was capable of operating selectively on 120 volt AC or from a 12 battery power supply, the newer improved system is an all modular, low voltage 12 VDC amplifier powered by a 12 volt DC battery or directly from a 12 VDC power source, such as from a vehicle. This new low voltage system prevents accidental short-circuiting to the 120 volt AC line, thereby providing a much safer operating system. A 120 VAC/12 VDC adapter provides recharging of the battery. Further, older models utilized a 30-watt horn type speaker that was capable of being overdriven by the system amp, whereas the newer models now utilize a 60 watt directional horn type speaker to prevent such overdriving and maintain the output in the mid range. The higher wattage 60-watt speakers provided on the basic model may now be replaced with a pair of 15–25 watt horn speakers as well. Unlike earlier models, all optional components are now interchangeable between models. Additionally, a tape player is provided with the system to provide prerecorded programming.

BRIEF DESCRIPTION OF THE DRAWINGS

For a further understanding of the nature and objects of the present invention, reference should be made to the following detailed description taken in conjunction with the accompanying drawings, in which, like parts are given like reference numerals, and wherein.

DETAILED DESCRIPTION OF THE PREFERRED EMBODIMENT

Figure 1:
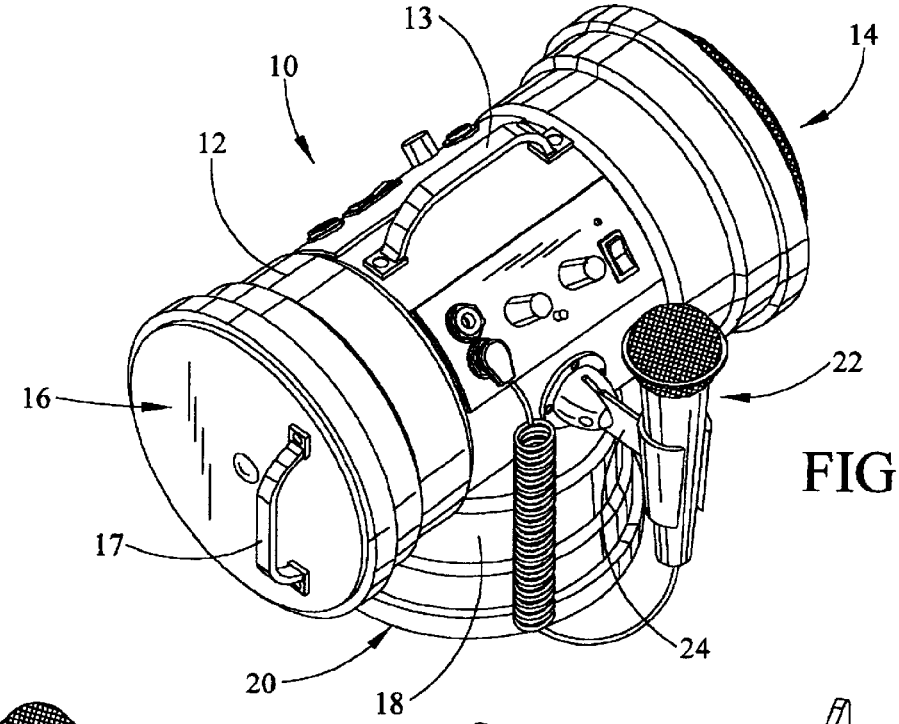
FIG. 1 is an isometric view of a first embodiment of the PA system.

A first embodiment of the basic portable public address (PA) system 10 is illustrated in FIG. 1. This model is compact, measuring only 21.5 inches by 11.5 inches by 10.25 high, and lightweight, weighing only 20 lbs. The unit may be described as having a tubular "T" shaped housing having a carrying handle 13 with the main body 12 of the "T" having two ends, one of which is fitted with a main, high quality 6.5 inch, 120 watt two-way speaker assembly 14 having a metal protective grill. The opposite end is fitted with a tubular plug assembly 16, which also serves as a speaker cord housing. The branch portion 18 of the tubular "T" shaped housing is fitted with a support base, plug assembly 20. The basic model system 10 is also fitted with a plug type, heavy duty, unidirectional/dynamic, low impedance microphone 22 and a pivotal microphone holder 24. The pivotal microphone holder 24 provides for hands free operation and ease of transport.

Figure 2:
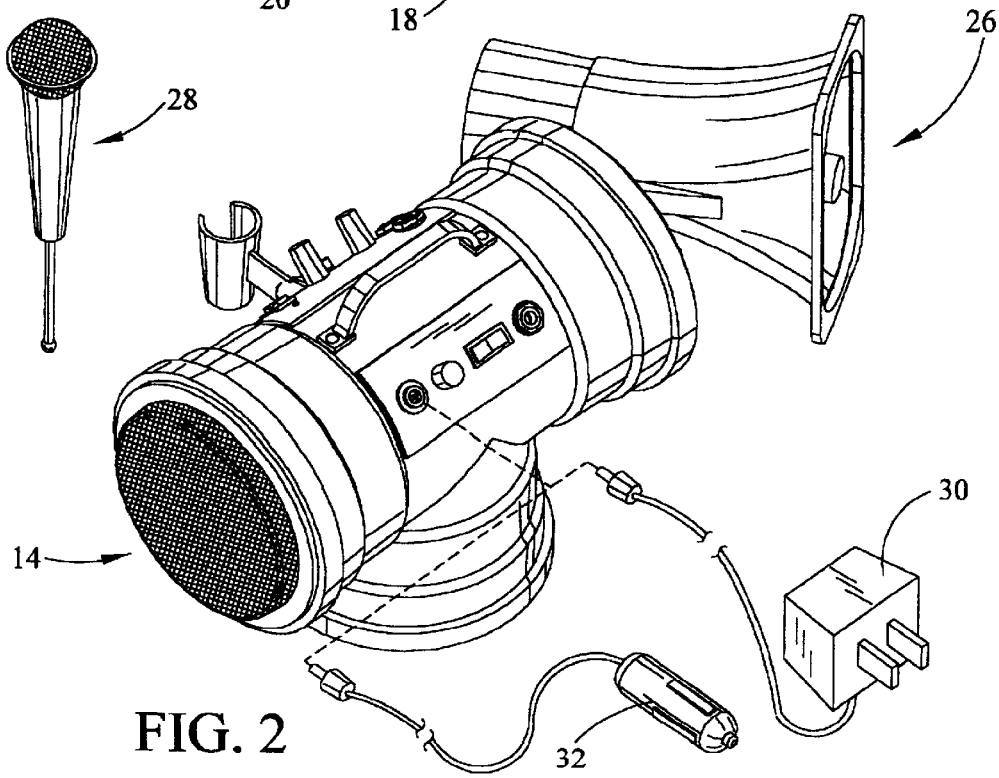
FIG. 2 is an isometric view of the first embodiment illustrated in FIG. 1 with additional accessories.

The basic model may be expanded, as seen in FIG. 2, to include a 60-watt directional, horn type speaker assembly 26, a remote wireless RF microphone system 28, and battery charging adapters 30, 32. Charging adapters 30, 32 provided with all units allow the 12 VDC battery power supply to be re-charged from an AC/DC or DC voltage sources.

Figure 3:
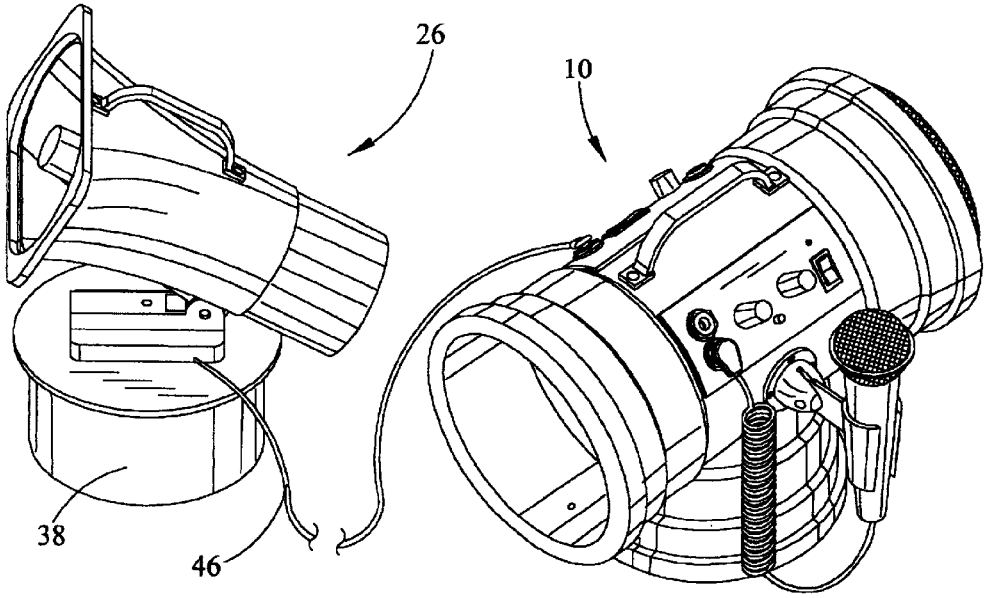
FIG. 3 is an isometric view of the first embodiment illustrated in FIG. 1 with horn speaker deployed.

As seen in FIG. 3, the horn speaker assembly 26 may be attached by replacing the housing tubular plug assembly 16 inserted in the end of the tubular "T" portion 12 with the speaker assembly 26, thereby providing dual event capability. By so doing, the main two-way 30-watt speaker may be used indoors or for relatively small audiences to play music and the like and the larger horn type 60-watt speaker is useful for larger audiences outdoors, primarily for voice amplification.

Feedback may be reduced by using the remote wireless microphone, which allows the PA unit 10 to be placed a considerable distance away from and in front of the microphone. Further, the entire PA unit 10 may be elevated by placement on a platform and the horn speaker assembly 26 positioned horizontally for directional address or also may be deployed some distance from the PA unit 10 as illustrated in FIG. 3.

Figure 4A:
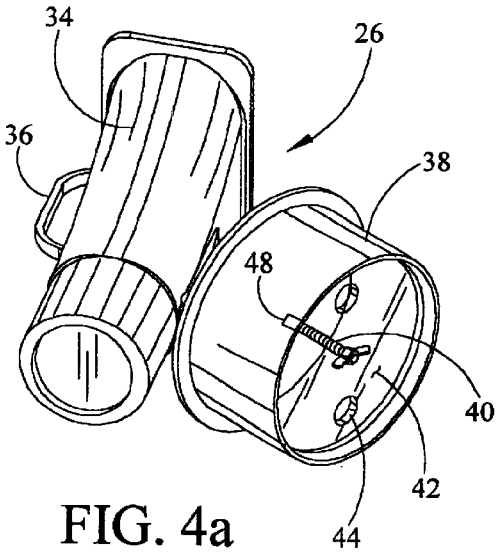
FIG. 4*a* is an isometric view of the combination horn speaker mounting base assembly.

The horn speaker assembly 26 as shown in FIG. 4*a* includes a pivotally mounted horn speaker 34 with a handle 36 and the tubular plug housing 38, which also includes a central stem member 40 and a polymeric plate member 42, preferably of clear plastic, having a pair of apertures 44 therein as finger holes for easy removal whenever necessary. The plate 42 is smaller in diameter than the inside of the plug housing 38 and removably mounted to the stem member 40. This allows the speaker cord 46 to be optionally attached to the speaker externally as seen in FIG. 3 or internally spooled from behind and around the plate member 42 as shown in FIG. 4*b*.

Figure 4B:
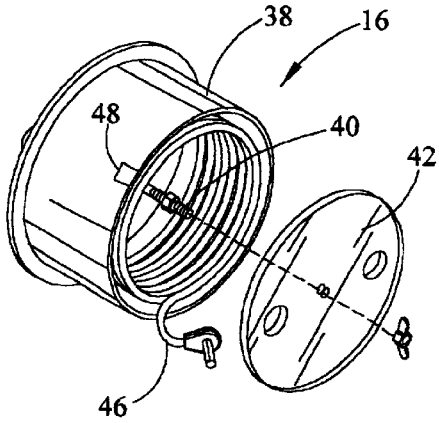
FIG. 4*b* is an isometric view of the housing plug assembly including cord caddy.

The plug housing 16, first seen in FIG. 1 and detailed in FIG. 4*b*, includes an external handle 17 and is otherwise essentially the same as Item 38 in FIG. 4*a*, with the exception of the handle, and may also include the items 40–44 as well. A notch 48 may also be provided to allow for the cord 46 to exit from inside the housing when the speaker is deployed as seen in FIG. 3. A patch cord may be stored in the plug housing 16 for use with auxiliary input devices.

Figure 5:
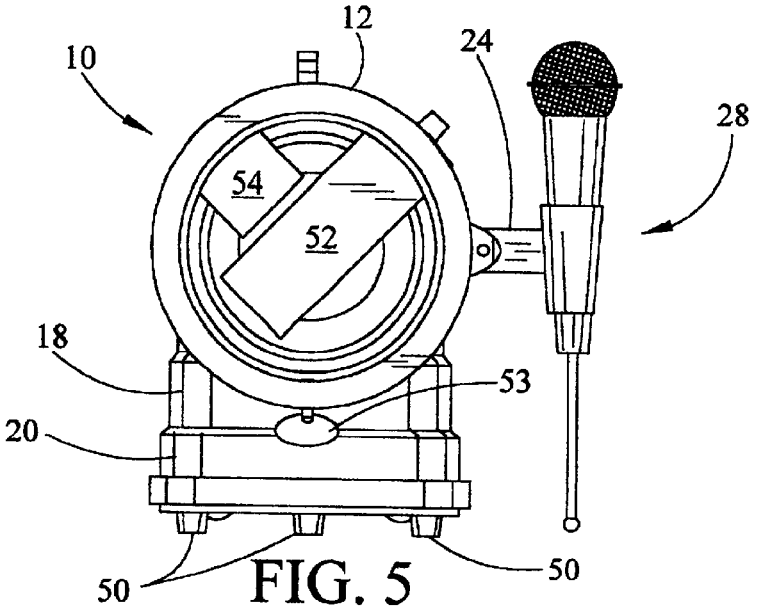
FIG. 5 is a vertical end view of the first embodiment as illustrated in FIG. 3.

Turning now to FIG. 5, we see a vertical side view showing components inside the unit 10. As seen here the base plug assembly 20 includes a plurality of rubber feet members 50 serving as sound vibration isolation members and a thumb screw 53 threadably inserted through the main body housing for locking the end plug members 38 in any rotated position, thereby allowing the horn speaker 34 to be positioned in two planes. We also see that the electrical components are confined within two modules 52 and 54 with module 52 being the principle amplifier and controls and module 54 being the connection module for recharge power control.

Figure 6:
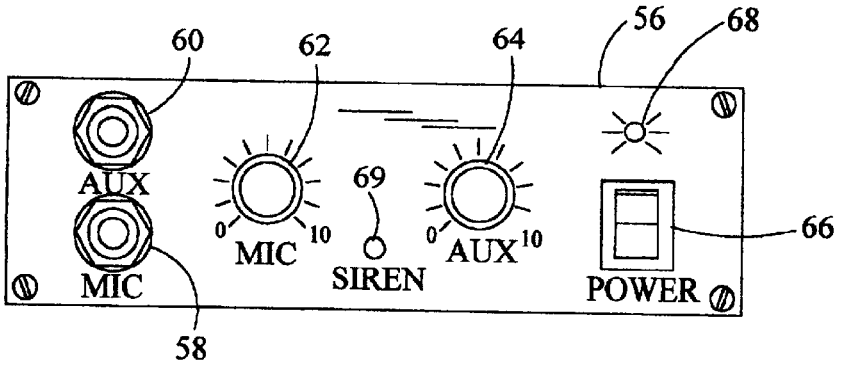
FIG. 6 is a top view of connection plate No. 1 used with the first embodiment.

As may be seen in FIG. 6, the amplifier module 52 is retained within the main "T"-shaped housing by a flange plate 56 which contains a jack plug 58 for receiving input from a microphone (However, a remote wireless RF microphone system may be substituted if desired.), an auxiliary jack plug 60 for receiving input from a device such as a radio, compact disk, or tape player, a volume control 62 for controlling the volume of the speakers 14, 28, a volume control 64 for auxiliary input at jack 60, a power control switch 6, and a power indicator light 68. An onboard, internal, electronically produced siren is also provided and activated by push button 69.

Figure 7:
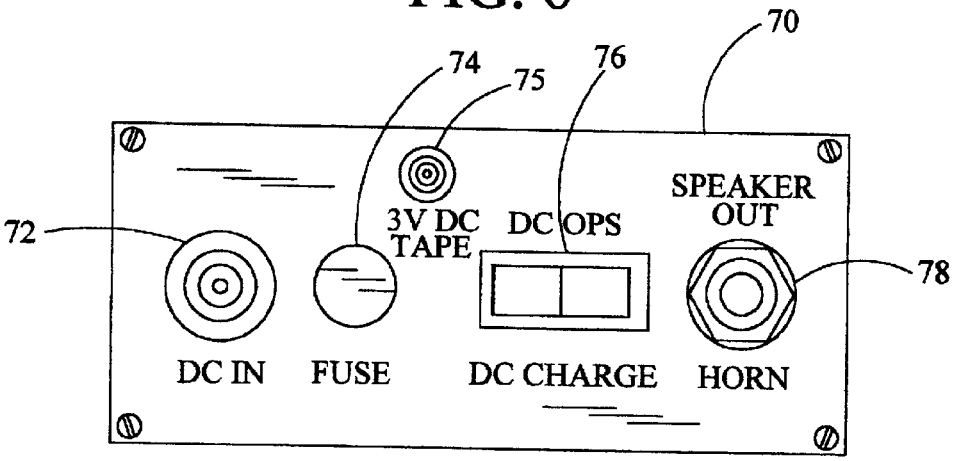
FIG. 7 is a top view of connection plate No. 2 used with the first embodiment.

Unlike earlier models an input power module 54 is provided and secured within the housing body 12 by flange plate 70 seen in FIG. 7. The power module 54 contains a DC power input jack 72, a fuse holder 74, a power selector switch 76 for power input jack 72 that selects external DC power input operation or battery charging operation, and a speaker output jack 78 and a 3 VDC power supply jack 75 for powering an external recorder. The output of the recorder 146 seen in FIGS. 17–19 connects to the Auxiliary input jack 60.

Figure 8:
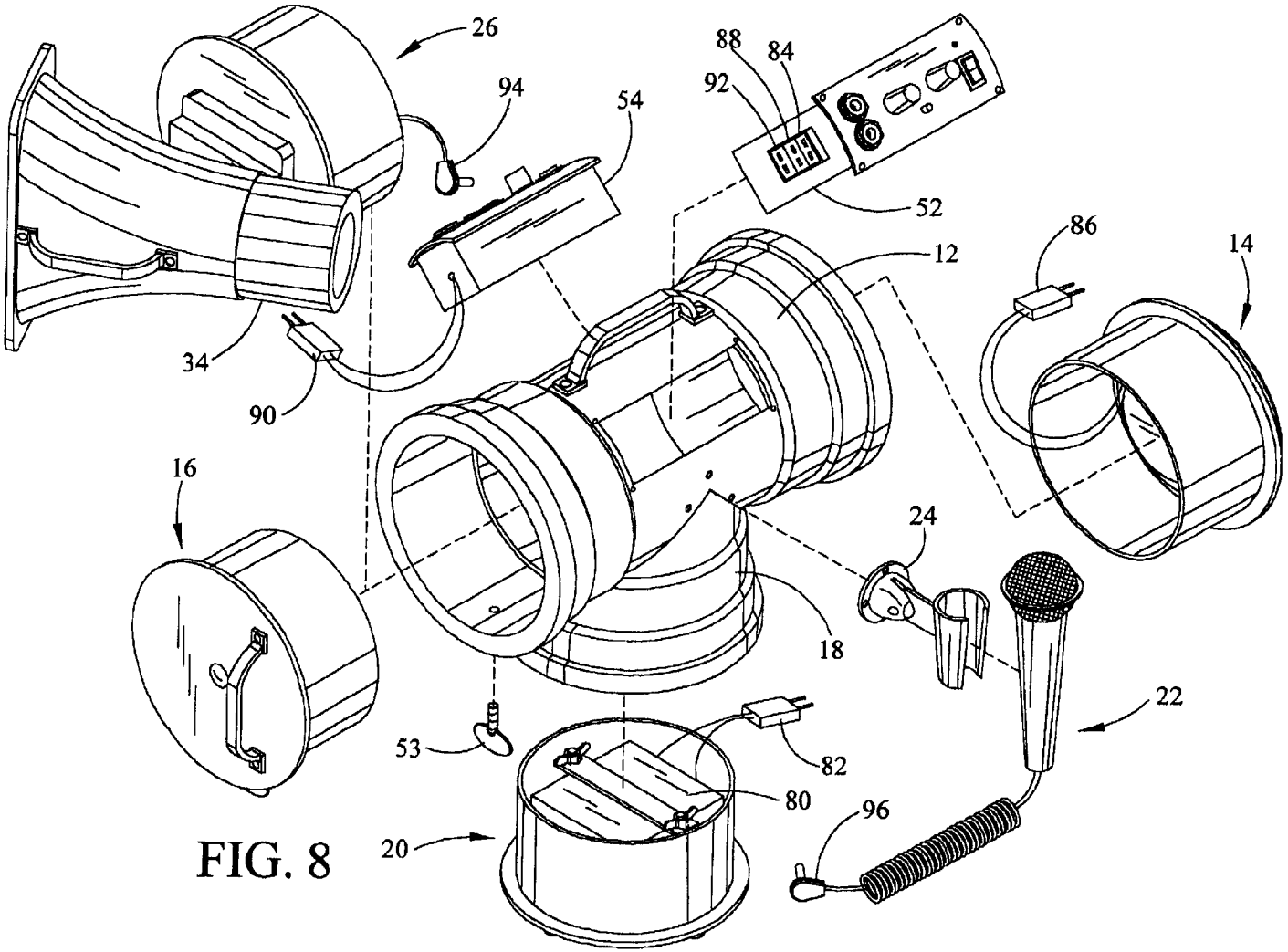
FIG. 8 is an exploded view of the first embodiment Illustrated in FIG. 1.

Looking now at FIG. 8, we see that the improved PA system 10 is comprised of the previously discussed group of plug in module assemblies that are now removably attached to the "T" shaped tubular housing 12,18. The control module 52 is now interchangeably and electrically connected with connecting plugs with each modular component.

The 12-volt DC 5 ampere hour, rechargeable, sealed lead acid battery pack 80 is connected by plug 82 to the central control module 52 at connector 84. The two-way 30-watt speaker 14 is also connected by plug 86 to the central control module 52 at connector 88, as is the external power input control module 54 with plug 90 with connector 92. 60-watt speaker 34 is connected to the control module 54 by way of plug 94 and input microphone 23 is connected to the control module 52 by plug 96.

Figure 9:
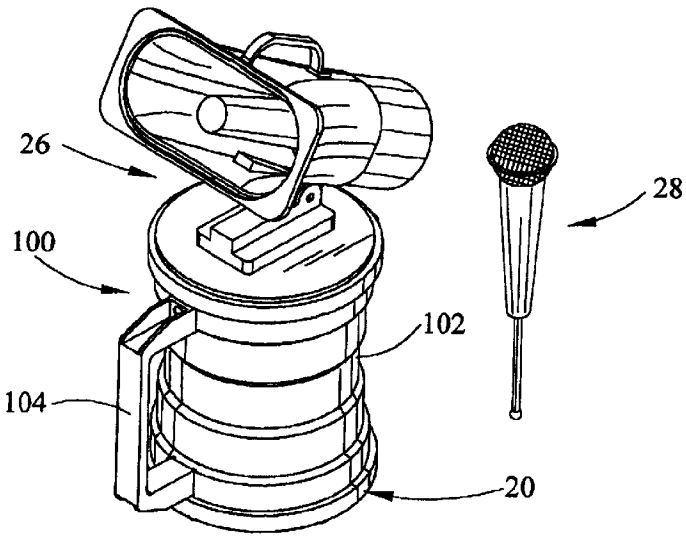
FIG. 9 is an isometric view of a second embodiment of the invention.
Figure 10:
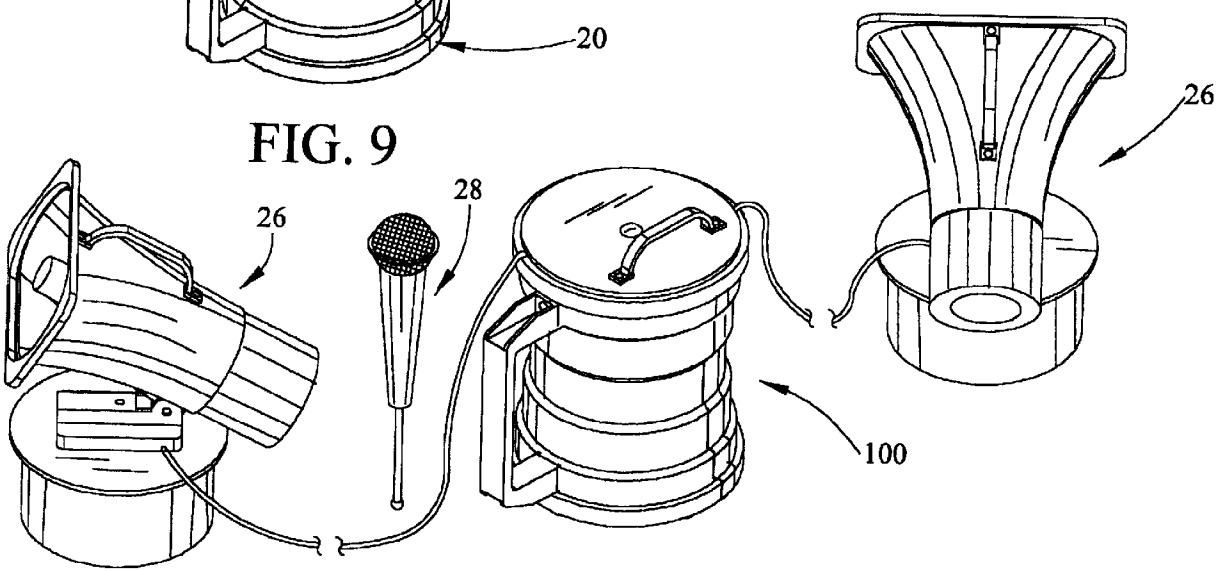
FIG. 10 is an isometric view of the second embodiment with dual horn speakers remotely deployed.
Figure 11:
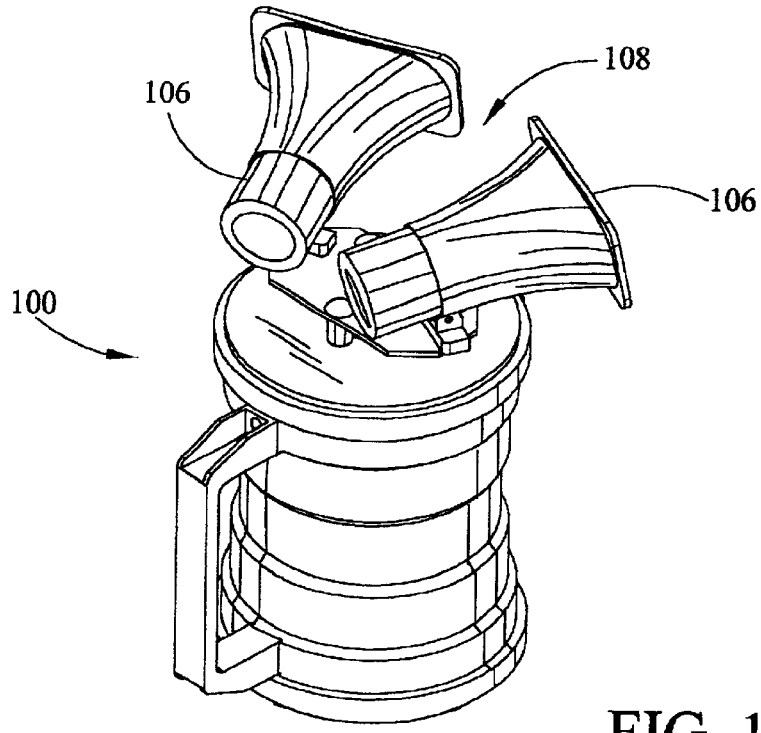
FIG. 11 is an isometric view of the second embodiment with dual horn speakers attached to a removable base.

An entirely new embodiment 100 is illustrated in FIG. 9 and represents an even more compact PA system measuring only 9½ inches high and 7½ inches in diameter. This embodiment is weatherproof and designed principally for outdoor use, even in inclement weather. Two or more systems, utilizing a pair of speakers with each unit, may be used simultaneously with a single remote microphones tuned to multiple receivers on the same frequency, thereby providing broad coverage at sporting events, such as ball games, or for strategic placement and use by duck hunters on or near water. Embodiment 100, comprises an elongated housing 102 configured for receiving modular tubular plug assemblies 20 and 26, utilized with the first embodiment 10, at each end of the housing. The housing further includes an external handle 102 for transport. The interchangeability of all modular components allows the system to be configured in a variety of ways to accommodate specific situations and environments. This embodiment 100 is exclusively adapted for use with a remote wireless microphone 28. A pair of speaker plug assemblies 16 may also be used with a remote two-horn speaker configuration as seen in FIG. 10. Alternatively, the second embodiment 100 may be configured with an alternative plug assembly 108 which includes a pair of 12-volt, 15 to 25 watt, 5×8×8 inch long, weatherproof, horn type speakers 106 as illustrated in FIG.

Figure 12:
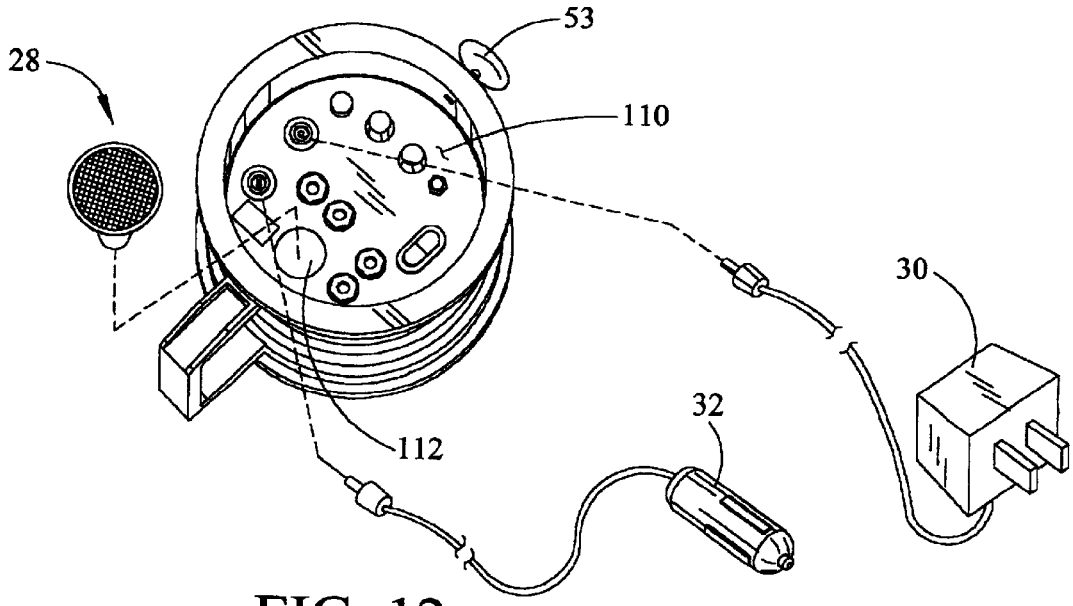
FIG. 12 is an isometric view of the interior of the second embodiment illustrated in FIG. 10 with accessories.

11. Removing the speaker plug assembly 108 from the housing 102 exposes the system control panel 110 as seen in FIG. 12. An aperture 112 in the panel 110 is provided for storing the remote wireless microphone 28. An AC/DC converter 30 and a 12-volt DC vehicle adapter 32 are also provided with this embodiment as well.

Figure 13:
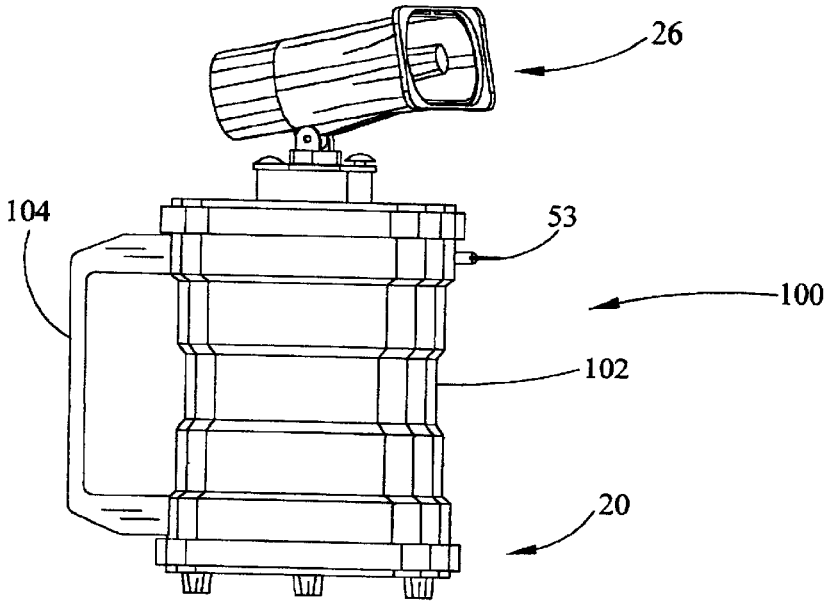
FIG. 13 is a vertical side view of the second embodiment illustrated in FIG. 11.

As seen in FIG. 13, we see that this embodiment 100 includes the same speaker assembly 26 and base plug assembly 20 as used with embodiment 10.

Figure 14:
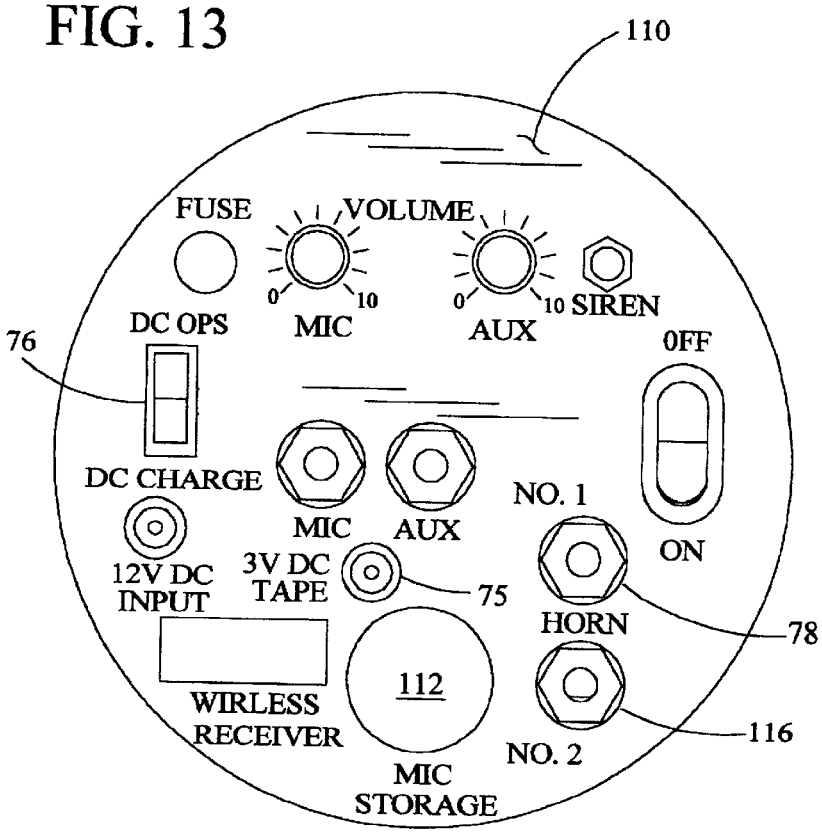
FIG. 14 is a top view of the connection plate illustrated in FIG. 12.
Figure 15:
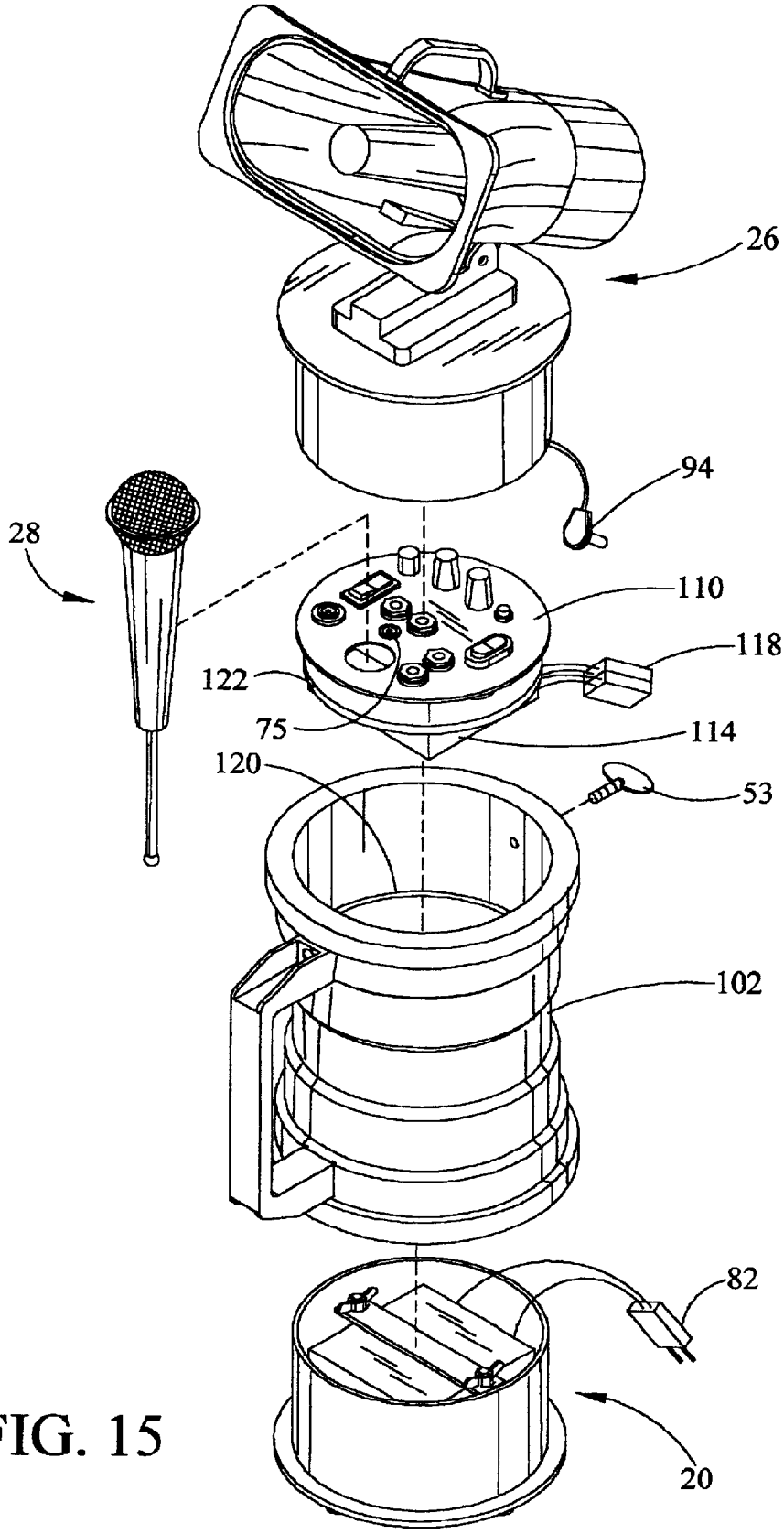
FIG. 15 is an exploded view of the second embodiment illustrated in FIG. 9.

FIG. 14 indicates that this embodiment 100 contains a single control flange plate 110 attached directly to the control module 114, better seen in FIG. 15. The flange plate includes essentially the same switches, jacks, and controls found on the first embodiment 10 except, in this case, a second speaker jack 116 has been added as well as the aperture 112 for storing the remote wireless microphone.

As further seen in FIG. 15, the base plug assembly 20 is inserted into the elongated vertical housing 102 and adhered thereto. The control module is electrically connected by plug member 82 to control connecter 118 and inserted in the housing 102 and held in position against a ledge 20 located midway along the interior of the vertical housing 102 and retained in position by an o-ring seal 122. Either a blank plug assembly 16, speaker plug module 26, or the dual speaker plug assembly 108 may be selected for attachment to the PA unit.

Figure 16:
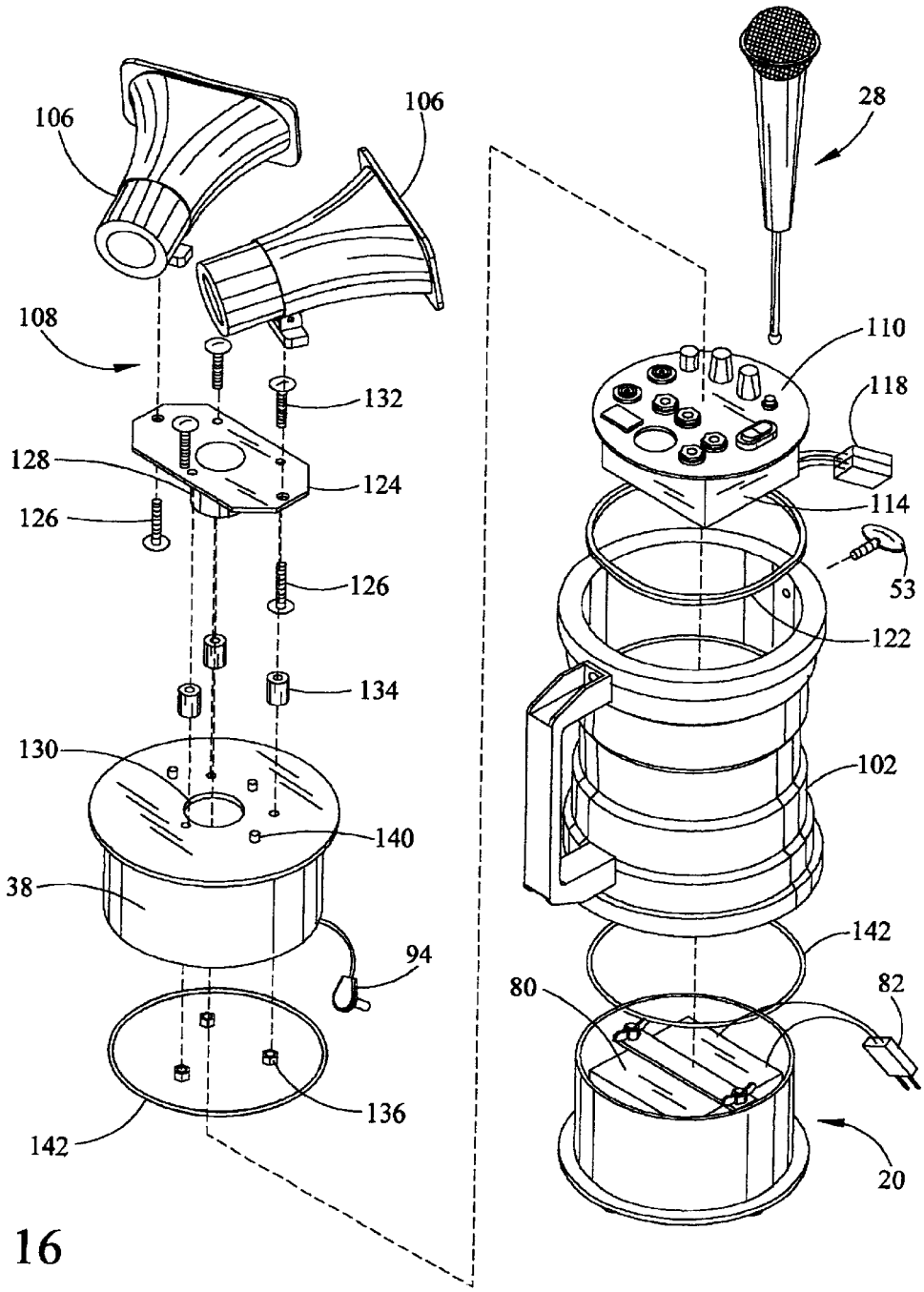
FIG. 16 is an exploded view of the second embodiment illustrated in FIG. 11.

FIG. 16 demonstrates the assemblage of the dual speaker assembly 108 and sealing method for making the system weatherproof. In this assembly the horn speakers 106 having vertical pivotal mounts are pivotally located at approximately 60 degrees apart on a common adapter plate 124 and secured thereto by fasteners 126. Adapter plate 124 is fitted with a central column 128 and is slidable through aperture 130, the adapter plate being secured to the housing plug member 38 by fasteners 132 and held in a spaced apart relationship by spacers 134 and secured thereto by threaded nuts 136. Vent tubes 140 are also installed in the housing plug member 38 directly below the adapter plate 124 as external air vents to allow heat to escape. One such vent may be used to route a wire for connecting an external antenna when required for the remote wireless microphone. As further seen in FIG. 16, sealing rings 142 are also provided with each plug-in module.

Figure 17:
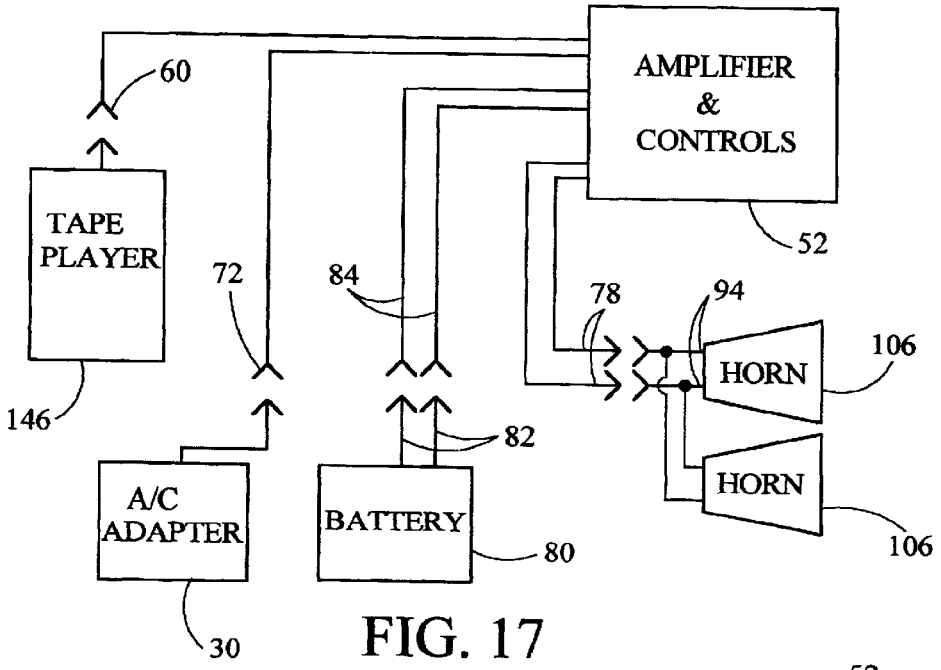
FIG. 17 is a block diagram and plug connection of the invention with internal type player and dual horn speakers.
Figure 18:
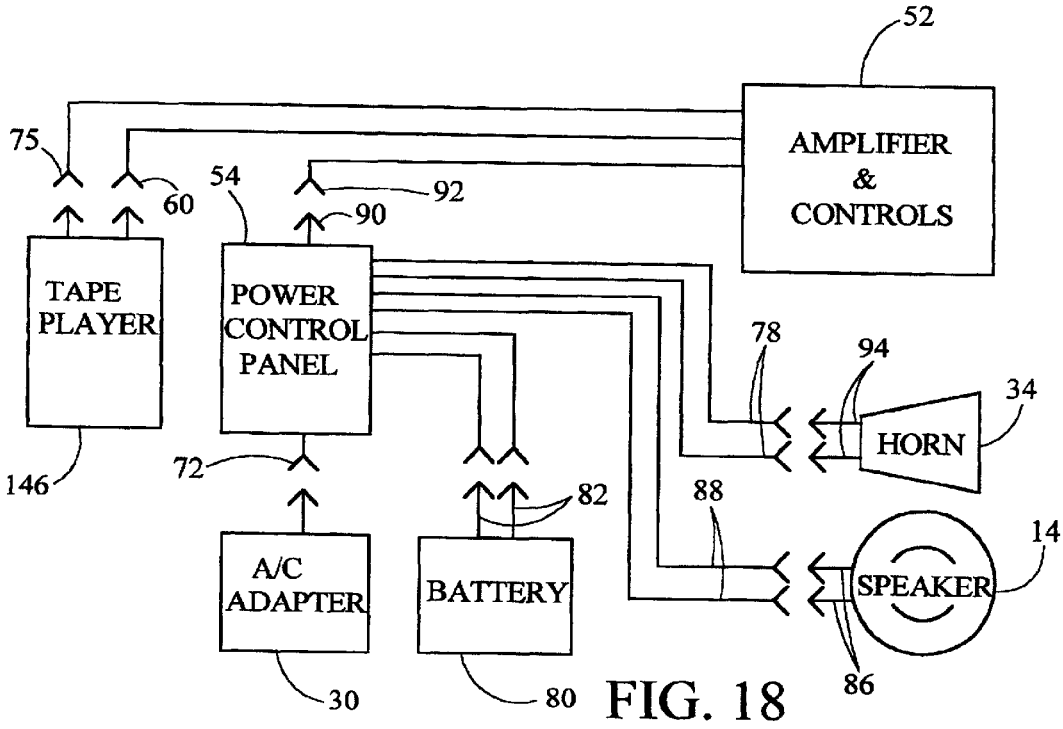
FIG. 18 is a block diagram and plug connection of the invention with optional power control and speaker selection.
Figure 19:
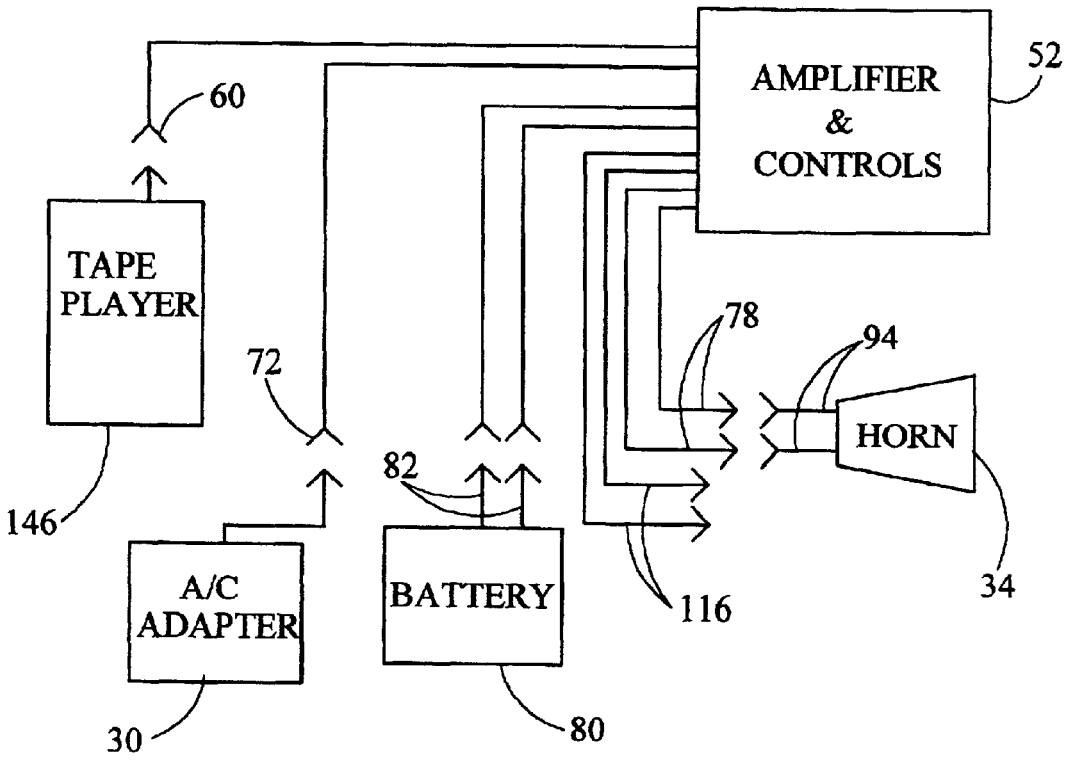
FIG. 19 is a block diagram and plug connection of the invention with internal type player and single or multiple horn speaker provision.

Looking at FIG. 17, we see the amplifier and control module 52 is powered by a disconnectable nominal 12-volt battery 80 or by an optional AC to DC voltage reducer/converter 30 commonly used in the art for connecting to any 120-volt outlet. The voltage reducer reduces the voltage from 120 VAC to nominal 12 VDC for powering the 12 VDC amplifier. External speakers in this case may be a pair of horn type directional speakers 106, as seen in FIG. 16, connected in parallel, thereby providing broader coverage than a single speaker used alone. Obviously, an amplifier may be provided with any wattage capability; however, it has been found that a compact, portable PA system such as described herein is most effective with an approximately 30-watt output. Therefore, the output may be adapted to any speaker combination that is greater than the 30 watts available. i.e. two 30-watt directional horn speakers in parallel connected to a single output jack, an optional 30-watt omni-directional 30 speaker 14 or a 60-watt direction horn speaker 34, as seen in FIG. 18, or a pair of 60-watt horn speaker assemblies 26, as shown deployed in FIG. 10, connected by separate jacks 78, 116 as seen in FIG. 14 and shown optionally connected in FIG. 19. However, in the latter case it is desirable to have the speakers operate in their mid range and thus prevent the possibility of overdriving the speakers. As further seen in FIGS. 17–19, a tape player 146 may be used as an input device, simultaneously with a microphone, when plugged into the auxiliary jack 60. Taped music, repetitious voice recordings, or special sounds such as duck calls, etc., may also be played and amplified through the system. The tape player may be alternatively powered directly from the amplifier 52 with the 3 VDC power jack 75 as illustrated in FIGS. 7, and 14.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in any limiting sense.

What is claimed is:

1. A self-contained portable public address system comprising:

a) a hollow, tubular "T"-shaped polymeric housing having a main body portion and a perpendicular branch portion, said main body portion having first and second apertures located opposite said branch portion;

b) a first tubular plug member having at least one elastomeric isolation member removably inserted into an end of said branch portion;

c) a second tubular plug member having a two-way omni-directional speaker secured therein, removably inserted into one end of said main body portion;

d) a third tubular plug member having an external handle and internal spool members, removably inserted into an end of said main body portion opposite said two way omni-directional speaker;

e) a first modular, electrical control panel inserted into said first aperture in said main body portion and removably secured thereto;

f) a second modular, electrical control panel inserted into said second aperture in said main body portion and removably secured thereto;

g) a battery power supply removably attached internally to said first tubular plug member; and h) a quick coupling means for electrically interconnecting said power supply with said first and second modular electrical control panels and said speaker.

2. The self-contained, portable public address system according to claim 1 wherein said system further comprises a handle attached to said main body portion.

3. The self-contained, portable public address system according to claim 1 wherein said system further comprises a pivotal microphone holder attached externally to said main body portion.

4. The self-contained, portable public address system according to claim 1 wherein said system further comprises a tubular plug member having at least one directional horn-type speaker pivotally mounted thereto, removably inserted into an end of said main body portion opposite said two-way omni-directional speaker.

5. The self-contained portable public address system according to claim 1 wherein said first modular, electrical control panel is a 12 volt D.C. amplifier having alternative DC power supplies, primary and auxiliary sound inputs, volume controls, speaker outputs and onboard electronic siren, and an external recording apparatus powered by said DC power supplies.

6. The self-contained portable public address system according to claim 5 further comprising a microphone removably connected to said first modular, electrical control panel.

7. The self-contained portable public address system according to claim 5 further comprising a means for playing recordings connected to said auxiliary sound input.

8. The self-contained portable public address system according to claim 5 further comprising means for receiving RF signals from a wireless remote microphone.

9. The self-contained portable public address system according to claim 1 further comprising an AC to DC power adapter for powering said 12 DC amplifier from an AC power source.

10. The self-contained portable public address system according to claim 1 further comprising an adapter means for recharging said battery power supply.

11. The self-contained portable public address system according to claim 5 wherein said 12-volt amplifier comprises speaker outputs of between 15 and 30 watts.

12. A self-contained portable public address system comprising:

a) an elongated, hollow tubular case;

b) a first tubular plug member having at least one elastomeric isolation member attached externally thereto, removably inserted into an end of said tubular case;

c) a battery power supply removably attached internally to said first tubular plug member;

d) a second tubular plug member having an external handle and internal spool members, removably inserted into an end of said tubular case opposite said first tubular plug member;

e) a modular, electrical control panel located within said elongated hollow tubular case located midway between said first and second tubular plug members and removably secure therein;

f) a means for electrically connecting said battery power supply to said electrical control panel; and g) a sealing means attached to each of said first and second tubular plug members and said electrical control panel for making said portable public address system weatherproof.

13. The self-contained portable public address system according to claim 12 which further comprises at least one tubular plug member adaptable to an end of said elongated hollow case opposite said first tubular plug member comprising at least one externally mounted horn type speaker, said speaker being electrically connectable to said electrical control panel.

14. The self-contained portable public address system according to claim 12 wherein said electrical control panel further comprises a receiving means for receiving RF signals from a remote wireless microphone.

15. The self-contained portable public address system according to claim 14 wherein said electrical control panel further comprises a means for powering an external recording apparatus.

16. The self-contained portable public address system according to claim 12 wherein said electrical control panel is a 12 volt DC amplifier having alterative DC power supplies, primary and auxiliary sound inputs, volume controls, speaker outputs and onboard electronic siren, and an external recording apparatus powered by said DC power supplies.

17. The self-contained portable public address system according to claim 16 wherein said electrical control panel further comprises an aperture for insertion and storage of said remote wireless microphone.

18. The self-contained portable public address system according to claim 12 further comprising an AC to DC power converter for powering said control panel from an A.C. power source.

19. The self-contained portable public address system according to claim 12 further comprising a means for recharging said battery power supply from said AC power source.

20. The self-contained portable public address system according to claim 12 wherein all components attachable to said elongated hollow tubular case are modular and interchangeable with optional components.

21. The self-contained portable public address system according to claim 16 wherein said amplifier comprises speaker outputs of between 15 and 30 watts.

22. A self-contained portable public address system comprising:

a) an elongated hollow tubular case;

b) a first tubular plug member having at least one elastomeric isolation member attached externally thereto, removably inserted into an end of said tubular case;

c) a battery power supply removably attached internally to said first tubular plug member;

d) a second tubular plug member adaptable to an end of said elongated hollow case opposite said first tubular plug member comprising at least one externally mounted horn type speaker said speaker being electrically connectable to said electrical control panel, e) a modular, electrical control panel located within said elongated hollow tubular case located midway between said first and second tubular plug members and removably secure therein;

f) a means for electrically connecting said battery power supply to said electrical control panel; and g) a sealing means attached to each of said first and second tubular plug members and said electrical control panel for making said portable public address system weatherproof.

23. The self-contained portable public address system according to claim 22 wherein said second tubular plug member is detachable for remote deployment.

* * * * *